US011790842B1

(12) United States Patent
Zhou et al.

(10) Patent No.: US 11,790,842 B1
(45) Date of Patent: Oct. 17, 2023

(54) DRIVING CIRCUIT, DISPLAY PANEL, AND DISPLAY DEVICE

(71) Applicant: HKC CORPORATION LIMITED, Guangdong (CN)

(72) Inventors: Renjie Zhou, Guangdong (CN); Rongrong Li, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/334,970

(22) Filed: Jun. 14, 2023

(30) Foreign Application Priority Data

Oct. 12, 2022 (CN) ..... 202211248818.6

(51) Int. Cl.
*G09G 3/32* (2016.01)

(52) U.S. Cl.
CPC ..... *G09G 3/32* (2013.01); *G09G 2300/0842* (2013.01); *G09G 2310/0291* (2013.01); *G09G 2320/043* (2013.01)

(58) Field of Classification Search
CPC ..... G09G 2300/0842; G09G 3/32; G09G 2310/0291; G09G 2320/043
See application file for complete search history.

(56) References Cited

U.S. PATENT DOCUMENTS 7,138,968 B2 * 11/2006 Kasai ..... G09G 3/325 345/82
2005/0093792 A1 5/2005 Yamamoto et al.
2011/0001731 A1 1/2011 Park et al.
2014/0022226 A1 * 1/2014 Lee ..... G09G 3/3233 345/82
2014/0333214 A1 * 11/2014 Okuno ..... G09G 3/32 315/172
2014/0333600 A1 * 11/2014 Lee ..... G09G 3/325 345/212

(Continued)

FOREIGN PATENT DOCUMENTS

CN 106504706 A 3/2017
CN 108831384 A 11/2018

(Continued)

OTHER PUBLICATIONS

Notice of Allowance for Invention issued in corresponding CN application No. 2022112488186 dated Nov. 18, 2022.

*Primary Examiner* — Muhammad N Edun
(74) *Attorney, Agent, or Firm* — HAUPTMAN HAM, LLP

(57) ABSTRACT

A driving circuit, a display panel, and a display device are provided. In the driving circuit, a first and second light-emitting control sub-circuits are configured to drive a light-emitting unit to emit light; an energy storage element; an operational sub-circuit is configured to compare a voltage at a point where the energy storage element is electrically connected with the operational sub-circuit with a reference voltage to obtain an output signal; a first data input sub-circuit is turned on or off according to the output signal, and when turned on, transmit a first data signal to the first and second light-emitting control sub-circuits to drive the light-emitting unit to emit light; a second data input sub-circuit is configured to be turned on or off according to the output signal, and when turned on, transmit a second data signal to the first and second light-emitting control sub-circuits to drive the light-emitting unit to emit light.

16 Claims, 4 Drawing Sheets

(56) References Cited

U.S. PATENT DOCUMENTS

| | | | | |
|---|---|---|---|---|
| 2014/0347332 | A1* | 11/2014 | Lee | G09G 3/3233 345/204 |
| 2018/0190198 | A1 | 7/2018 | Kim | |

FOREIGN PATENT DOCUMENTS

| | | | |
|---|---|---|---|
| CN | 112349241 | A | 2/2021 |
| CN | 114283734 | A | 4/2022 |
| CN | 114566124 | A | 5/2022 |
| EP | 3783595 | A1 | 2/2021 |
| JP | 2016109956 | A | 6/2016 |
| KR | 20100077390 | A | 7/2010 |

* cited by examiner

DRIVING CIRCUIT, DISPLAY PANEL, AND DISPLAY DEVICE

CROSS REFERENCE TO RELATED APPLICATION(S)

This application claims priority to and the benefit of Chinese Application No. 202211248818.6, filed Oct. 12, 2022, the entire disclosure of which is hereby incorporated by reference.

TECHNICAL FIELD

The present application relates to the field of display technology, and in particular, to a driving circuit, a display panel having the driving circuit, and a display device having the display panel.

BACKGROUND

At present, when a display screen works for a long time, since a Direct Current (DC) data signal (Data) is driven for a long time, the service life of a Thin Film Transistor (TFT) is shortened, which affects the service life of a product.

Therefore, how to solve the problem that the service life of the TFT is shortened due to long-time driving of the DC Data signal is a problem to be solved urgently by those skilled in the art.

SUMMARY

A driving circuit is provided. The driving circuit includes: a first light-emitting control sub-circuit and a second light-emitting control sub-circuit, both of which are electrically connected to a light-emitting unit, an energy storage element, an operational sub-circuit, a first data input sub-circuit, a second data input sub-circuit, and a first power supply voltage end, wherein the first light-emitting control sub-circuit and the second light-emitting control sub-circuit are both configured to drive the light-emitting unit to emit light; an anode of the light-emitting unit is electrically connected to the first light-emitting control sub-circuit, the second light-emitting control sub-circuit, the energy storage element, and the operational sub-circuit, a cathode of the light-emitting unit is electrically connected to a second power supply voltage end, and the light-emitting unit is configured to emit light; the energy storage element is electrically connected to the operational sub-circuit and is configured to store electric energy; the operational sub-circuit is electrically connected to the first data input sub-circuit, the second data input sub-circuit, and a reference voltage end, and is configured to compare a voltage at a point where the energy storage element and the operational sub-circuit are electrically connected with a reference voltage received at the reference voltage end, to obtain an output signal, and transmit the output signal to the first data input sub-circuit and the second data input sub-circuit; the first data input sub-circuit is electrically connected with the second data input sub-circuit and a first data signal end, and is configured to be turned on or off according to the output signal transmitted through the operational sub-circuit, and transmit a first data signal input at the first data signal end to the first light-emitting control sub-circuit and the second light-emitting control sub-circuit when being turned on, to drive the light-emitting unit to emit light; the second data input sub-circuit is electrically connected to a second data signal end, and is configured to be turned on or off according to an output signal transmitted through the operational sub-circuit, and transmit a second data signal input at the second data signal end to the first light-emitting control sub-circuit and the second light-emitting control sub-circuit when being turned on, to drive the light-emitting unit to emit light.

Based on the same inventive concept, the present disclosure further provides a display panel, including the above driving circuit, where the driving circuit is used for displaying an image.

Based on the same inventive concept, the present disclosure further provides a display device including the above display panel.

BRIEF DESCRIPTION OF THE DRAWINGS

To describe the technical solutions in the implementations of the present disclosure more clearly, the following briefly introduces the accompanying drawings required for describing the implementations. Apparently, the accompanying drawings in the following description show merely some implementations of the present disclosure, and a person of ordinary skill in the art may still derive other drawings from these accompanying drawings without creative efforts.

DESCRIPTION OF REFERENCE NUMERALS

Figure 1:
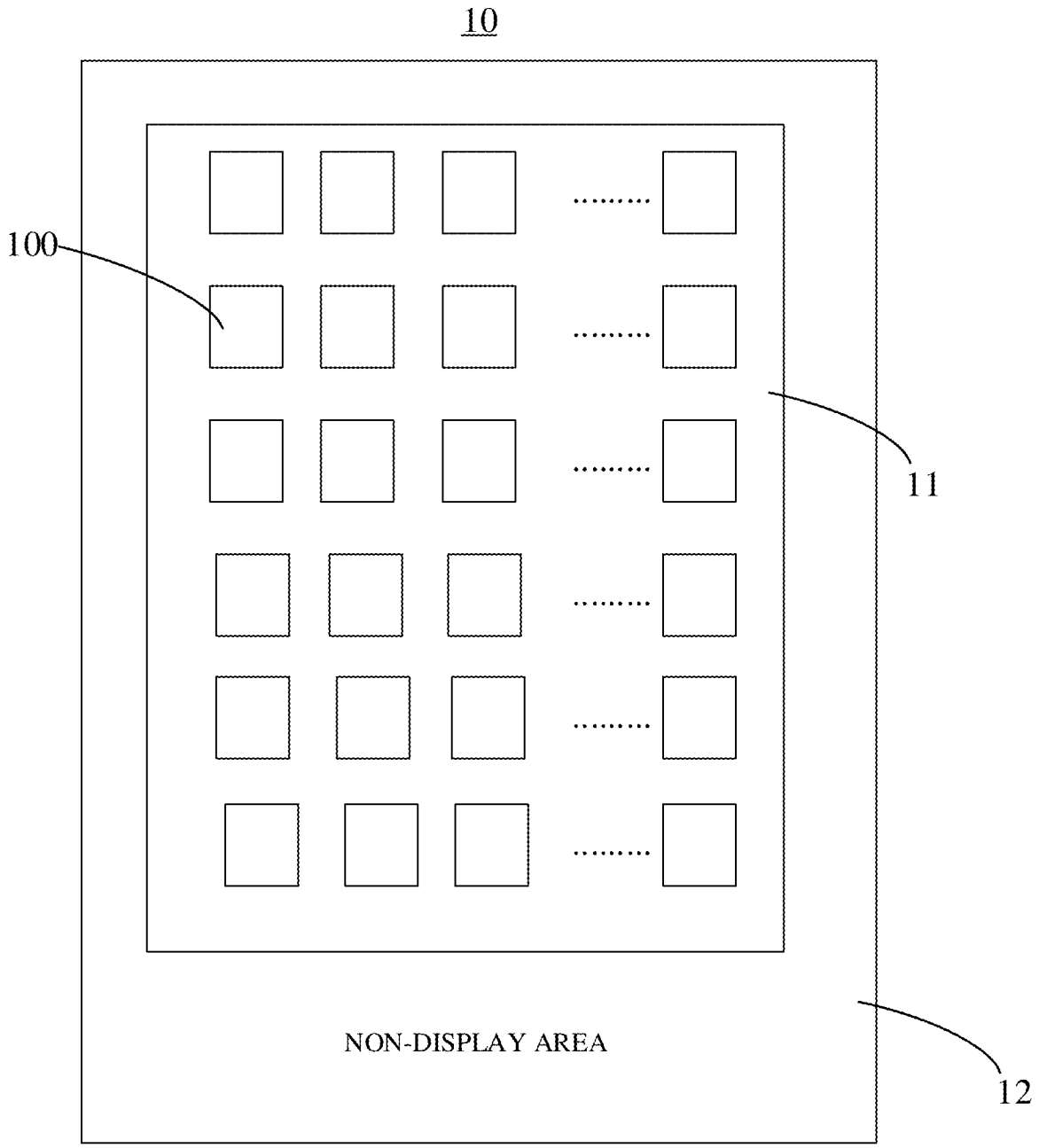
FIG. 1 is a schematic structural diagram of a display panel provided in implementations of the present disclosure.

10: display panel; 11: display area; 12: non-display area; 100: driving circuit; 110: first light-emitting control sub-circuit; 120: second light-emitting control sub-circuit; 140: light-emitting unit; 150: energy storage element; 160: operational sub-circuit; 180: first data input sub-circuit; 190: second data input sub-circuit; 210: first power supply voltage end; 220: second power supply voltage end; 230: reference voltage end; 250: first data signal end; 260: second data signal end; T1: first driving transistor; T2: second driving transistor; C1: storage capacitor; U1: amplifier; T3: first switching transistor; T4: second switching transistor; $V_{dd}$: first power supply voltage; $V_{ss}$: second power supply voltage; $V_{ref}$: reference voltage

DETAILED DESCRIPTION

In order to facilitate understanding of the present disclosure, the present disclosure will be described more fully hereinafter with reference to the accompanying drawings. Preferred implementations of the present disclosure are shown in the drawings, but the present disclosure may be implemented in many different forms and is not limited to the implementations described herein. Rather, these implementations are provided so that this disclosure will be thorough and complete.

The following description of the embodiments refers to the accompanying drawings to illustrate specific implementations of the present disclosure. Sequential reference themselves, such as "first", "second", etc., are used merely to distinguish between described objects and do not have any ordinal or technical meaning. However, the expressions "connected" and "coupled" in the present disclosure, unless otherwise specified, both include direct connection and indirect connection. Directional terms mentioned in the present disclosure, for example, "upper", "lower", "front", "rear", "left", "right", "inner", "outer", "side" and the like are only directions with reference to the accompanying drawings, and therefore, the directional terms are used for better and clearer illustration and understanding of the present disclosure, rather than indicate or imply that the indicated device or element must have a particular orientation, be constructed and operated in a particular orientation, therefore, it cannot be understood that the present disclosure is limited thereto.

In the description of the present disclosure, it should be noted that, unless specified or limited otherwise, the terms "mounted", "connected with", and "connected to" should be understood broadly, for example, may be fixedly connected, may also be detachably connected, or may be integrally connected; may also be mechanical connections; may also be direct connections or indirect connections via intervening structures; and may also be inner communications of two elements. The specific meanings of the above terms in the present disclosure can be understood by those skilled in the art according to specific situations. It should be noted that terms such as "first" and "second" in the description and claims and drawings of the present disclosure are used for distinguishing different objects, rather than for describing a specific sequence.

In addition, as used herein, the term "include", "may include", "contain" or "may contain" indicates the existence of a corresponding disclosed function, operation, element, etc., and does not exclude one or more other functions, operations, elements, etc. In addition, the terms "comprise" or "include" means that there are corresponding features, numbers, steps, operations, elements, components, or a combination thereof disclosed in the specification, and do not exclude the presence or addition of one or more other features, numbers, steps, operations, elements, components, or a combination thereof, and are intended to cover a non-exclusive inclusion. In addition, when describing implementations of the present disclosure, "can" or "may" is used to mean "one or more implementations of the present disclosure". Also, the term "exemplary" is intended to mean exemplary or illustrative.

Unless defined otherwise, all technical and scientific terms used herein have the same meaning as commonly understood by one of ordinary skill in the art to which this application belongs. The terminology used herein in the description of the present disclosure is for the purpose of describing particular implementations only and is not intended to be limiting of the present disclosure.

In view of the described deficiencies of the prior art, an object of the present disclosure is to provide a driving circuit, so as to solve the problem that the service life of a TFT is shortened due to long-time driving of a direct current Data signal, thereby improving the service life of a product.

The driving circuit includes: a first light-emitting control sub-circuit and a second light-emitting control sub-circuit, both of which are electrically connected to a light-emitting unit, an energy storage element, an operational sub-circuit, a first data input sub-circuit, a second data input sub-circuit, and a first power supply voltage end, wherein the first light-emitting control sub-circuit and the second light-emitting control sub-circuit are both configured to drive the light-emitting unit to emit light; an anode of the light-emitting unit is electrically connected to the first light-emitting control sub-circuit, the second light-emitting control sub-circuit, the energy storage element, and the operational sub-circuit, a cathode of the light-emitting unit is electrically connected to a second power supply voltage end, and the light-emitting unit is configured to emit light; the energy storage element is electrically connected to the operational sub-circuit and is configured to store electric energy; the operational sub-circuit is electrically connected to the first data input sub-circuit, the second data input sub-circuit, and a reference voltage end, and is configured to compare a voltage at a point where the energy storage element and the operational sub-circuit are electrically connected with a reference voltage received at the reference voltage end, to obtain an output signal, and transmit the output signal to the first data input sub-circuit and the second data input sub-circuit; the first data input sub-circuit is electrically connected with the second data input sub-circuit and a first data signal end, and is configured to be turned on or off according to the output signal transmitted through the operational sub-circuit, and transmit a first data signal input at the first data signal end to the first light-emitting control sub-circuit and the second light-emitting control sub-circuit when being turned on, to drive the light-emitting unit to emit light; the second data input sub-circuit is electrically connected to a second data signal end, and is configured to be turned on or off according to an output signal transmitted through the operational sub-circuit, and transmit a second data signal input at the second data signal end to the first light-emitting control sub-circuit and the second light-emitting control sub-circuit when being turned on, to drive the light-emitting unit to emit light.

In an exemplary implementation, the first light-emitting control sub-circuit includes a first driving transistor, a gate of the first driving transistor is electrically connected to the second light-emitting control sub-circuit, the first data input sub-circuit, and the second data input sub-circuit, a drain of the first driving transistor is electrically connected to the second light-emitting control sub-circuit and the first power supply voltage end, a source of the first driving transistor is electrically connected to the second light-emitting control sub-circuit, the anode of the light-emitting unit, the energy storage element, and the operational sub-circuit, the first driving transistor is configured to drive the light-emitting unit to emit light.

In an exemplary implementation, the second light-emitting control sub-circuit includes a second driving transistor, the gate of the second driving transistor is electrically connected to the gate of the first driving transistor, the first data input sub-circuit and the second data input sub-circuit, a source of the second driving transistor is electrically connected to the drain of the first driving transistor and the first power supply voltage end, a drain of the second driving transistor is electrically connected to the source of the first driving transistor, the anode of the light-emitting unit, the energy storage element, and the operational sub-circuit, and the second driving transistor is configured to drive the light-emitting unit to emit light.

In an exemplary implementation, the energy storage element includes a storage capacitor, a first end of the storage capacitor is electrically connected to the source of the first driving transistor, the anode of the light-emitting unit, the drain of the second driving transistor, and the operational sub-circuit, a second end of the storage capacitor is grounded, and the energy storage element is configured for charging and storing electric energy.

In an exemplary implementation, the operational sub-circuit includes an amplifier, a non-inverting input end of the amplifier is electrically connected between the drain of the second driving transistor and the first end of the storage capacitor to receive a voltage at a point where the energy storage element is electrically connected to the operational sub-circuit, and an inverting input end of the amplifier is configured to input the reference voltage received at the reference voltage end, an output end of the amplifier is electrically connected to the first data input sub-circuit and the second data input sub-circuit, the amplifier is configured to compare a voltage at the point where the energy storage element and the operational sub-circuit are electrically connected with the reference voltage received at the reference voltage end, to obtain a corresponding output signal, and transmit the output signal to the first data input sub-circuit and the second data input sub-circuit.

In an exemplary implementation, the first data input sub-circuit includes a first switch transistor, a gate of the first switch transistor is electrically connected to an output end of the amplifier and the second data input sub-circuit, a source of the first switch transistor is electrically connected to the first data signal end, and a drain of the first switch transistor is electrically connected to a gate of the first driving transistor, a gate of the second driving transistor, and the second data input sub-circuit, the first switch transistor is configured to be turned on or off according to an output signal transmitted by an output end of the amplifier, and transmit the first data signal input at the first data signal end to the gate of the first driving transistor and the gate of the second driving transistor when being turned on.

In an exemplary implementation, the second data input sub-circuit includes a second switch transistor, a gate of the second switch transistor is electrically connected to an output end of the amplifier and a gate of the first switch transistor, a source of the second switch transistor is electrically connected to the gate of the first driving transistor, the gate of the second driving transistor, and the drain of the first switch transistor, a drain of the second switch transistor is electrically connected to the second data signal end, and the second switch transistor is configured to be turned on or off according to an output signal transmitted by an output end of the amplifier, and transmit the second data signal input at the second data signal end to the gate of the first driving transistor and the gate of the second driving transistor when being turned on.

In an exemplary implementation, the first data signal is a direct current data signal, and the second data signal is an alternating current data signal.

In summary, in the driving circuit, after the light-emitting unit starts to operate, the storage capacitor starts to be charged, when the voltage at the point where the energy storage element and the operational sub-circuit are electrically connected is lower than a reference voltage output at the reference voltage end, the amplifier outputs a low level signal, the first data input sub-circuit is turned on, and transmits the first data signal input at the first data signal end to the gate of the first driving transistor and the gate of the second driving transistor, and the first driving transistor or the second driving transistor is turned on. When the voltage at the point where the energy storage element and the operational sub-circuit are electrically connected is higher than the reference voltage output at the reference voltage end, the amplifier outputs a high level signal, the second switch transistor is turned on, and the second data signal input at the second data signal end is transmitted to the gate of the first driving transistor and the gate of the second driving transistor, so that the first driving transistor or the second driving transistor is turned on, in this way, the direct current driving is switched to the alternating current driving, and as a result, the service life of the TFT is effectively prolonged.

Implementations of the present disclosure are intended to provide a technical solution of a driving circuit, a display panel, and a display device, which can solve the described technical problem, so as to solve the problem that the service life of a Thin Film Transistor (TFT) is shortened due to long-time driving of a direct current Data signal, thereby improving the service life of a product. Details thereof will be set forth in the following implementations.

Please refer to FIG. 1, which is a schematic structure diagram of a display panel provided in implementations of the present disclosure. In the implementation, the display panel 10 includes a display area (active area) 11 and a non-display area 12. The display area 11 is used for image display, and the non-display area 12 surrounds the display area 11 and is not used for image display. The display panel 10 further includes multiple driving circuits 100, and each of the multiple driving circuits 100 is disposed in the display area 11 for displaying images. It should be understood that, in some implementations, the display panel 10 may be a Micro Light-Emitting Diode (Micro LED) display panel or an organic light-emitting diode (OLED) display panel, but the present disclosure is not limited thereto.

It can be understood that the display panel 10 may be used for an electronic device including functions such as a Personal Digital Assistant (PDA) and/or a music player, such as a mobile phone, a tablet computer, and a wearable electronic device (such as a smart watch and a smart bracelet) having a wireless communication function. The above electronic device may also be other electronic devices, such as a laptop computer (Laptop) with a touch-sensitive surface (e. g., touch panel), etc. In some implementations, the electronic device may have a communication function, that is, may establish communication with a network through a 2G (second generation mobile phone communication technology specification), a 3G (third generation mobile phone communication technology specification), a 4G (fourth generation mobile phone communication technology specification), a 5G (fifth generation mobile phone communication technology specification), a Wireless Local Area Network (W-LAN), or a possible communication mode in the future. For brevity, implementations of the present disclosure are not further defined.

Figure 2:
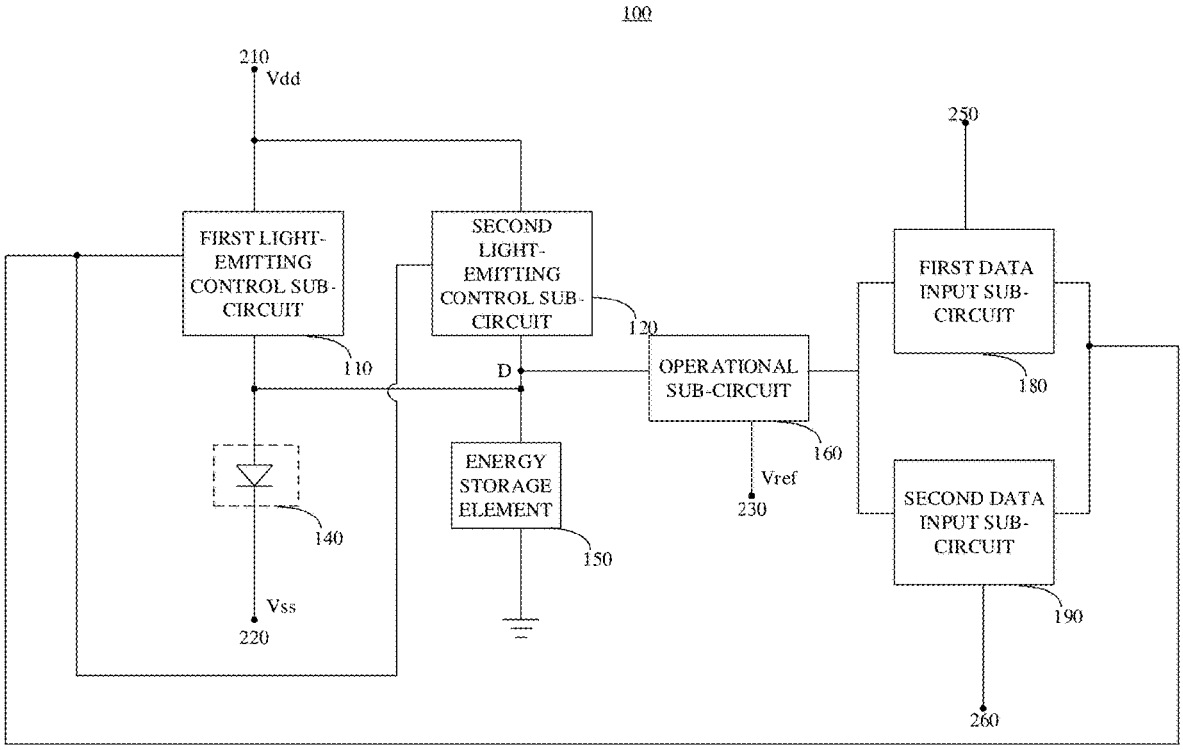
FIG. 2 is a schematic circuit diagram of a driving circuit provided in implementations of the present disclosure.

Please refer to FIG. 2, which is a schematic circuit diagram of a driving circuit provided in an implementation of the present disclosure. As shown in FIG. 2, the driving circuit 100 provided in the present disclosure may at least include a first light-emitting control sub-circuit 110, a second light-emitting control sub-circuit 120, a light-emitting unit 140, an energy storage element 150, an operational sub-circuit 160, a first data input sub-circuit 180, and a second data input sub-circuit 190.

The first light-emitting control sub-circuit 110 is electrically connected to the second light-emitting control sub-circuit 120, the light-emitting unit 140, the energy storage element 150, the operational sub-circuit 160, the first data input sub-circuit 180, the second data input sub-circuit 190, and the first power supply voltage end 210, and is configured to drive the light-emitting unit 140 to emit light. The first power supply voltage end 210 is configured to receive a first power supply voltage $V_{dd}$.

The second light-emitting control sub-circuit 120 is electrically connected to the first light-emitting control sub-circuit 110, the light-emitting unit 140, the energy storage element 150, the operational sub-circuit 160, the first data input sub-circuit 180, the second data input sub-circuit 190, and the first power supply voltage end 210, and is configured to drive the light-emitting unit 140 to emit light.

An anode of the light-emitting unit 140 is electrically connected to the first light-emitting control sub-circuit 110, the second light-emitting control sub-circuit 120, the energy storage element 150, and the operational sub-circuit 160, and a cathode of the light-emitting unit 140 is electrically connected to the second power supply voltage end 220. The light-emitting unit 140 is configured to emit light. The second power supply voltage end 220 is configured to receive a second power supply voltage $V_{ss}$, where the second power supply voltage $V_{ss}$ is a cathode connection reference voltage.

In implementations of the present disclosure, the light-emitting unit 140 may be a Micro LED.

The energy storage element 150 is electrically connected to the first light-emitting control sub-circuit 110, the second light-emitting control sub-circuit 120, the light-emitting unit 140, and the operational sub-circuit 160. The energy storage element 150 is configured to store electric energy. After the energy storage element 150 is charged, point D (for example, a midpoint position) located between the second light-emitting control sub-circuit 120 and the energy storage element 150 and electrically connected to the operational sub-circuit 160 obtains a point D voltage.

The operational sub-circuit 160 is electrically connected to the second light-emitting control sub-circuit 120, the energy storage element 150, the first data input sub-circuit 180, the second data input sub-circuit 190, and a reference voltage end 230, and is configured to compare the voltage at point D with the reference voltage $V_{ref}$ received at the reference voltage end 230 to obtain an output signal, and transmit the output signal to the first data input sub-circuit 180 and the second data input sub-circuit 190. The reference voltage end 230 is configured to receive the reference voltage Vref.

The first data input sub-circuit 180 is electrically connected to the first light-emitting control sub-circuit 110, the second light-emitting control sub-circuit 120, the operational sub-circuit 160, the second data input sub-circuit 190, and the first data signal end 250, and is configured to be turned on or off according to the output signal transmitted through the operational sub-circuit 160, and is configured to transmit a first data signal input at the first data signal end 250 to the first light-emitting control sub-circuit 110 and the second light-emitting control sub-circuit 120 when being turned on, so as to drive the light-emitting unit 140 to emit light. The first data signal may be a direct current data signal.

The second data input sub-circuit 190 is electrically connected to the first light-emitting control sub-circuit 110, the second light-emitting control sub-circuit 120, the operational sub-circuit 160, the first data input sub-circuit 180, and the second data signal end 260, and is configured to be turned on or off according to the output signal transmitted through the operational sub-circuit 160. The second data input sub-circuit 190 is configured to transmit a second data signal input at the second data signal end 260 to the first light-emitting control sub-circuit 110 and the second light-emitting control sub-circuit 120 when being turned on, so as to drive the light-emitting unit 140 to emit light. The second data signal is an alternating current data signal.

In conclusion, in the driving circuit, after the light-emitting unit 140 starts to work, the energy storage element 150 starts to be charged. When the voltage at point D is lower than the reference voltage $V_{ref}$ output at the reference voltage end 230, the operational sub-circuit 160 outputs a low level signal, the first data input sub-circuit 180 is turned on to transmit the first data signal input at the first data signal end 250 to the first light-emitting control sub-circuit 110 and the second light-emitting control sub-circuit 120, and the first light-emitting control sub-circuit 110 or the second light-emitting control sub-circuit 120 is turned on. When the voltage at point D is higher than the reference voltage $V_{ref}$ output at the reference voltage end 230, the operational sub-circuit 160 outputs a high level signal, and the second data input sub-circuit 190 is turned on to transmit the second data signal input at the second data signal end 260 to the first light-emitting control sub-circuit 110 and the second light-emitting control sub-circuit 120. Then the first light-emitting control sub-circuit 110 or the second light-emitting control sub-circuit 120 is turned on, so as to switch from the direct current driving to the alternating current driving, and as a result, the display life of the TFT is effectively prolonged.

Figure 3:
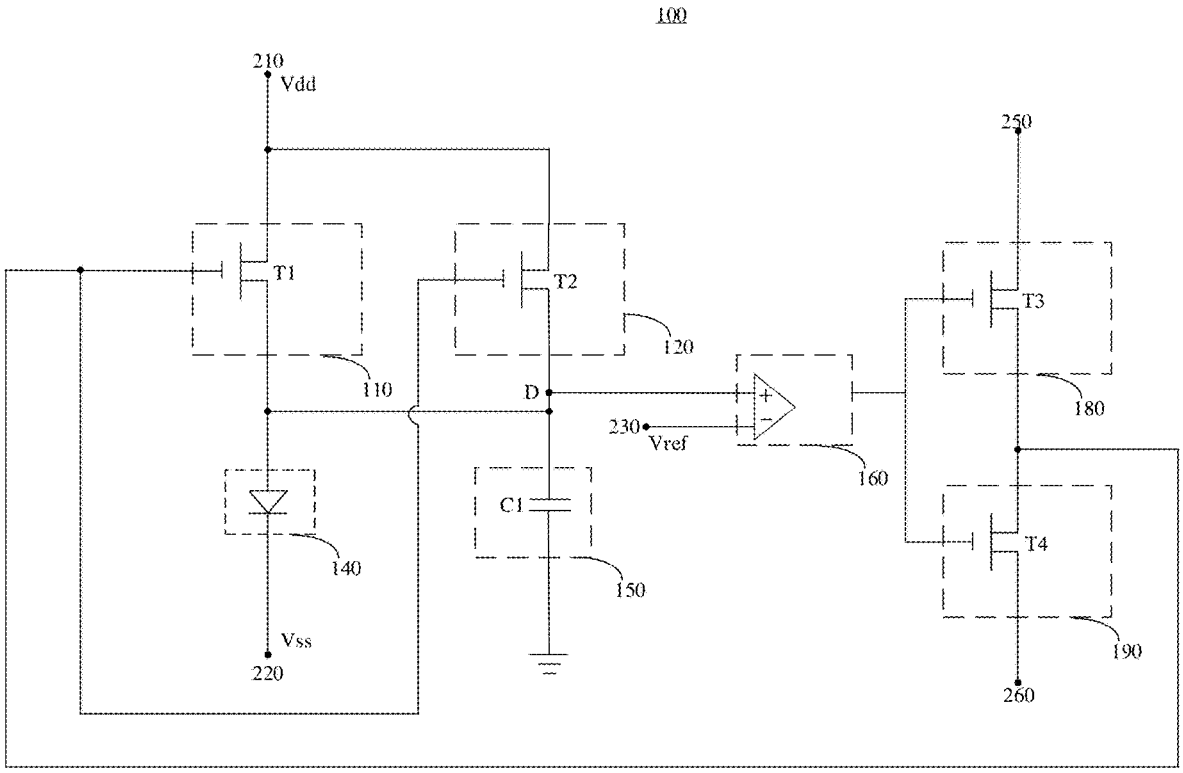
FIG. 3 is a schematic diagram illustrating a circuit structure of the driving circuit shown in FIG. 2.

Please refer to FIG. 3, FIG. 3 is a schematic diagram of a circuit structure of the driving circuit shown in FIG. 2. As shown in FIG. 3, the first light-emitting control sub-circuit 110 in the driving circuit 100 provided in the present disclosure includes a first driving transistor T1. A gate electrode ("gate" for short) of the first driving transistor T1 is electrically connected to the second light-emitting control sub-circuit 120, the first data input sub-circuit 180, and the second data input sub-circuit 190. A drain electrode ("drain" for short) of the first driving transistor T1 is electrically connected to the second light-emitting control sub-circuit 120 and the first power supply voltage end 210. A source electrode ("source" for short) of the first driving transistor T1 is electrically connected to the second light-emitting control sub-circuit 120, the anode of the light-emitting unit 140, the energy storage element 150, and the operational sub-circuit 160. The first driving transistor T1 is configured to drive the light-emitting unit 140 to emit light.

In implementations of the present disclosure, the first driving transistor T1 may be an N-type transistor.

The second light-emitting control sub-circuit 120 includes a second driving transistor T2. A gate of the second driving transistor T2 is electrically connected to the gate of the first driving transistor T1, the first data input sub-circuit 180, and the second data input sub-circuit 190. A source of the second driving transistor T2 is electrically connected to the drain of the first driving transistor T1 and the first power supply voltage end 210. A drain of the second driving transistor T2 is electrically connected to the source of the first driving transistor T1, the anode of the light-emitting unit 140, the energy storage element 150, and the operational sub-circuit 160. The second driving transistor T2 is configured to drive the light-emitting unit 140 to emit light.

In implementation of the present disclosure, the second driving transistor T2 may be a P-type transistor.

The energy storage element 150 includes a storage capacitor C1. A first end of the storage capacitor C1 is electrically connected to the source of the first driving transistor T1, the anode of the light-emitting unit 140, the drain of the second driving transistor T2, and the operational sub-circuit 160, and a second end of the storage capacitor C1 is grounded. The energy storage element 150 is configured to be charged and store electric energy.

The operational sub-circuit 160 includes an amplifier U1. A non-inverting input end of the amplifier U1 is electrically connected between the drain of the second driving transistor T2 and the first end of the storage capacitor C1, to receive the voltage at point D. The inverting input end of the amplifier U1 is configured to input the reference voltage $V_{ref}$ received at the reference voltage end 230. An output end of the amplifier U1 is electrically connected to the first data input sub-circuit 180 and the second data input sub-circuit 190. The amplifier U1 is configured to compare the voltage at point D with the reference voltage $V_{ref}$ received at the reference voltage end 230 to obtain a corresponding output signal, and transmit the output signal to the first data input sub-circuit 180 and the second data input sub-circuit 190.

In implementations of the present disclosure, the amplifier U1 may be an Operational Amplifier (OP).

The first data input sub-circuit 180 includes a first switch transistor T3. A gate of the first switch transistor T3 is electrically connected to the output end of the amplifier U1 and the second data input sub-circuit 190. A source of the first switch transistor T3 is electrically connected to the first data signal end 250, and a drain of the first switch transistor T3 is electrically connected to the gate of the first driving transistor T1, the gate of the second driving transistor T2, and the second data input sub-circuit 190. The first switch transistor T3 is configured to be turned on or off according to an output signal transmitted from the output end of the amplifier U1, and transmit the first data signal input at the first data signal end 250 to the gate of the first driving transistor T1 and the gate of the second driving transistor T2 when being turned on.

In implementations of the present disclosure, the first switching transistor T3 may be a P-type transistor.

The second data input sub-circuit 190 includes a second switch transistor T4. A gate of the second switch transistor T4 is electrically connected to the output end of the amplifier U1 and the gate of the first switch transistor T3. A source of the second switch transistor T4 is electrically connected to the gate of the first driving transistor T1, the gate of the second driving transistor T2, and the drain of the first switch transistor T3. A drain of the second switch transistor T4 is electrically connected to the second data signal end 260. The second switch transistor T4 is configured to be turned on or off according to the output signal transmitted from the output end of the amplifier U1, and transmit the second data signal input at the second data signal end 260 to the gate of the first driving transistor T1 and the gate of the second driving transistor T2 when being turned on.

In implementations of the present disclosure, the second switching transistor T4 may be an N-type transistor.

Figure 4:
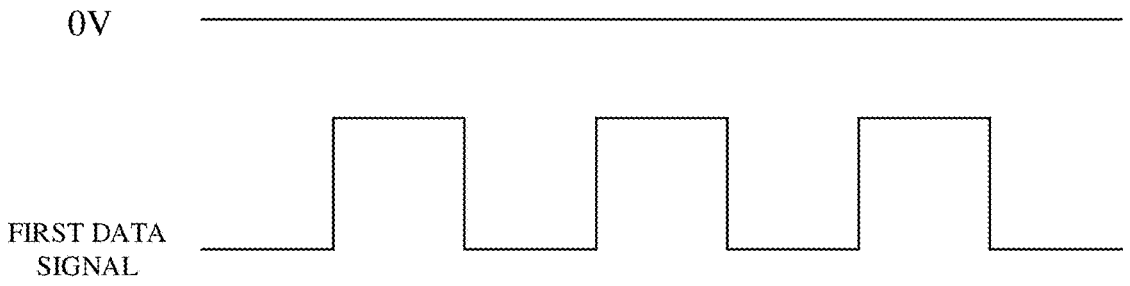
FIG. 4 is a timing diagram of a driving circuit provided in implementations of the present disclosure.

Please also refer to FIG. 4, which is a timing diagram of the driving circuit provided in implementations of the present disclosure. As shown in FIG. 4, when the first data signal is input at the first data signal end 250, the first data signal is input to the gate of the first driving transistor T1 and the gate of the second driving transistor T2, and the first driving transistor T1 or the second driving transistor T2 is turned on, so as to drive the light-emitting unit 140 to emit light, and the storage capacitor C1 starts charging. The voltage at point D is lower than the reference voltage $V_{ref}$ output at the reference voltage end 230, therefore the output end of the amplifier U1 outputs a low level signal, the first switch transistor T3 is turned on to transmit the first data signal input at the first data signal end 250 to the gate of the first driving transistor T1 and the gate of the second driving transistor T2, and the first driving transistor T1 or the second driving transistor T2 operates.

Figure 5:
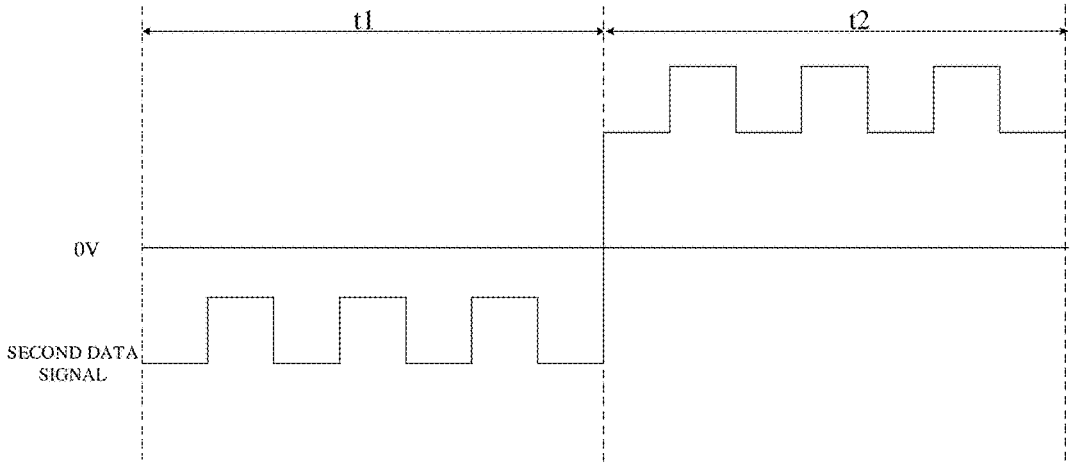
FIG. 5 is another timing diagram of the driving circuit provided in implementations of the present disclosure.

Please also refer to FIG. 5, which is another timing diagram of the driving circuit provided in implementations of the present disclosure, specifically, two phases t1 and t2 are selected in the timing diagram as shown in FIG. 5. Details of the timing diagram of the driving circuit shown in FIG. 5 will be described in the following implementations.

At phase t1 and phase t2, when the second data signal is input at the second data signal end 260, the second data signal input at the second data signal end 260 is transmitted to the gate of the first driving transistor T1 and the gate of the second driving transistor T2, such that the first driving transistor T1 or the second driving transistor T2 is turned on, so as to drive the light-emitting unit 140 to emit light, and the storage capacitor C1 starts charging. When the voltage at point D is higher than the reference voltage $V_{ref}$ output at the reference voltage end 230, the output end of the amplifier U1 outputs a level signal, the second switch transistor T4 is turned on to transmit the second data signal input at the second data signal end 260 to the gate of the first driving transistor T1 and the gate of the second driving transistor T2. The first driving transistor T1 and the second driving transistor T2 operate alternatively with a period of t1 and t2.

Specifically, at phase t1, when the second data signal is input at the second data signal end 260, the second data signal input at the second data signal end 260 is transmitted to the gate of the first driving transistor T1 and the gate of the second driving transistor T2, and the first driving transistor T1 is turned on, so as to drive the light-emitting unit 140 to emit light.

At phase t2, when the second data signal is input at the second data signal end 260, the second data signal input at the second data signal end 260 is transmitted to the gate of the first driving transistor T1 and the gate of the second driving transistor T2, and the second driving transistor T2 is turned on, so as to drive the light-emitting unit 140 to emit light.

In summary, in the driving circuit, after the light-emitting unit 140 starts to operate, the storage capacitor C1 starts to be charged. When the voltage at point D is lower than the reference voltage $V_{ref}$ output at the reference voltage end 230, the amplifier U1 outputs a low level signal. The first data input sub-circuit 180 is turned on and transmits the first data signal input at the first data signal end 250 to the gate of the first driving transistor T1 and the gate of the second driving transistor T2, and the first driving transistor T1 or the second driving transistor T2 is turned on. When the voltage at point D is higher than the reference voltage $V_{ref}$ output at the reference voltage end 230, the amplifier U1 outputs a high level signal. The second switch transistor T4 is turned on to transmit the second data signal input at the second data signal end 260 to the gate of the first driving transistor T1 and the gate of the second driving transistor T2, and the first driving transistor T1 or the second driving transistor T2 is turned on, so that the direct current driving is switched to the alternating current driving. As a result, the display life of the TFT is effectively prolonged.

Based on the same inventive concept, the present disclosure further provides a display device including the above display panel. The display device includes, but is not limited to, any electronic device or component having a display function such as a Micro LED panel, a mobile phone, a tablet computer, a navigator, and a display, which is not specifically limited in the present disclosure. According to the implementations of the present disclosure, the specific type of the display device is not particularly limited, and those skilled in the art can design the display device according to the specific use requirements of the display device, which will not be repeated here.

In one implementation, the display device further includes other necessary components and elements such as a power supply board, a high voltage board, and a key control board. Those skilled in the art can make supplement correspondingly according to the specific types and actual functions of the display device, and the description thereof is omitted here.

The flowchart described in this disclosure is merely an implementation, and modifications may be made to the illustration or steps in this disclosure without departing from the spirit of this disclosure. For example, the steps may be performed in a different order, or some steps may be added, omitted, or modified. Persons of ordinary skill in the art should understand that all or a part of the processes of the foregoing implementations may be implemented, and all or a part of the processes of the foregoing implementations still belong to the scope of the present disclosure.

Reference throughout this description to "implementation", "some implementations", "exemplary implementation", "example", "specific example" or "some examples" means that a particular feature, structure, material, or characteristic described in connection with the implementation or example is included in at least one implementation or example of the present disclosure. Thus, the appearances of the phrases in various places throughout this description are not necessarily referring to the same implementation or example of the present disclosure. Furthermore, the particular features, structures, materials, or characteristics described may be combined in any suitable manner in one or more implementations or examples.

It should be understood that the application of the present disclosure is not limited to the above examples, and those skilled in the art can make improvements or modifications according to the above descriptions, and all these improvements and modifications shall belong to the scope of protection of the appended claims of the present disclosure. A person of ordinary skill in the art may understand that all or a part of the methods for implementing the foregoing implementations, and the equivalent variations made according to the claims of the present disclosure still belong to the scope of protection of the present disclosure.

What is claimed is:

1. A driving circuit, comprising:

a first light-emitting control sub-circuit and a second light-emitting control sub-circuit, both of which are electrically connected to a light-emitting unit, an energy storage element, an operational sub-circuit, a first data input sub-circuit, a second data input sub-circuit, and a first power supply voltage end, wherein the first light-emitting control sub-circuit and the second light-emitting control sub-circuit are both configured to drive the light-emitting unit to emit light, wherein an anode of the light-emitting unit is electrically connected to the first light-emitting control sub-circuit, the second light-emitting control sub-circuit, the energy storage element, and the operational sub-circuit, a cathode of the light-emitting unit is electrically connected to a second power supply voltage end, and the light-emitting unit is configured to emit light;

the energy storage element is electrically connected to the operational sub-circuit and is configured to store electric energy;

the operational sub-circuit is electrically connected to the first data input sub-circuit, the second data input sub-circuit, and a reference voltage end, and is configured to compare a voltage at a point where the energy storage element and the operational sub-circuit are electrically connected with a reference voltage received at the reference voltage end to obtain an output signal, and transmit the output signal to the first data input sub-circuit and the second data input sub-circuit;

the first data input sub-circuit is electrically connected with the second data input sub-circuit and a first data signal end, and is configured to be turned on or off according to the output signal transmitted through the operational sub-circuit, and transmit a first data signal input at the first data signal end to the first light-emitting control sub-circuit and the second light-emitting control sub-circuit when being turned on, to drive the light-emitting unit to emit light;

the second data input sub-circuit is electrically connected to a second data signal end, and is configured to be turned on or off according to an output signal transmitted through the operational sub-circuit, and transmit a second data signal input at the second data signal end to the first light-emitting control sub-circuit and the second light-emitting control sub-circuit when being turned on, to drive the light-emitting unit to emit light.

2. The driving circuit of claim 1, wherein the first light-emitting control sub-circuit comprises a first driving transistor, a gate of the first driving transistor is electrically connected to the second light-emitting control sub-circuit, the first data input sub-circuit, and the second data input sub-circuit, a drain of the first driving transistor is electrically connected to the second light-emitting control sub-circuit and the first power supply voltage end, a source of the first driving transistor is electrically connected to the second light-emitting control sub-circuit, the anode of the light-emitting unit, the energy storage element, and the operational sub-circuit, the first driving transistor is configured to drive the light-emitting unit to emit light.

3. The driving circuit of claim 2, wherein the second light-emitting control sub-circuit comprises a second driving transistor, a gate of the second driving transistor is electrically connected to the gate of the first driving transistor, the first data input sub-circuit, and the second data input sub-circuit, a source of the second driving transistor is electrically connected to the drain of the first driving transistor and the first power supply voltage end, a drain of the second driving transistor is electrically connected to the source of the first driving transistor, the anode of the light-emitting unit, the energy storage element, and the operational sub-circuit, and the second driving transistor is configured to drive the light-emitting unit to emit light.

4. The driving circuit of claim 3, wherein the energy storage element comprises a storage capacitor, a first end of the storage capacitor is electrically connected to the source of the first driving transistor, the anode of the light-emitting unit, the drain of the second driving transistor, and the operational sub-circuit, a second end of the storage capacitor is grounded, and the energy storage element is configured to be charged and store electric energy.

5. The driving circuit of claim 4, wherein the operational sub-circuit comprises an amplifier, a non-inverting input end of the amplifier is electrically connected between the drain of the second driving transistor and the first end of the storage capacitor to receive a voltage at a point where the energy storage element is electrically connected to the operational sub-circuit, and an inverting input end of the amplifier is configured to input the reference voltage received at the reference voltage end, an output end of the amplifier is electrically connected to the first data input sub-circuit and the second data input sub-circuit, the amplifier is configured to compare a voltage at the point where the energy storage element and the operational sub-circuit are electrically connected with the reference voltage received at the reference voltage end, to obtain a corresponding output signal, and transmit the output signal to the first data input sub-circuit and the second data input sub-circuit.

6. The driving circuit of claim 5, wherein the first data input sub-circuit comprises a first switch transistor, a gate of the first switch transistor is electrically connected to an output end of the amplifier and the second data input sub-circuit, a source of the first switch transistor is electrically connected to the first data signal end, and a drain of the first switch transistor is electrically connected to the gate of the first driving transistor, the gate of the second driving transistor, and the second data input sub-circuit, the first switch transistor is configured to be turned on or off according to an output signal transmitted by an output end of the amplifier, and transmit the first data signal input at the first data signal end to the gate of the first driving transistor and the gate of the second driving transistor when being turned on.

7. The driving circuit of claim 6, wherein the second data input sub-circuit comprises a second switch transistor, a gate of the second switch transistor is electrically connected to an output end of the amplifier and the gate of the first switch transistor, a source of the second switch transistor is electrically connected to the gate of the first driving transistor, the gate of the second driving transistor, and the drain of the first switch transistor, a drain of the second switch transistor is electrically connected to the second data signal end, and the second switch transistor is configured to be turned on or off according to an output signal transmitted by an output end of the amplifier, and transmit the second data signal input at the second data signal end to the gate of the first driving transistor and the gate of the second driving transistor when being turned on.

8. The driving circuit of claim 7, wherein the first data signal is a direct current data signal, and the second data signal is an alternating current data signal.

9. The driving circuit of claim 6, wherein the first data signal is a direct current data signal, and the second data signal is an alternating current data signal.

10. The driving circuit of claim 5, wherein the first data signal is a direct current data signal, and the second data signal is an alternating current data signal.

11. The driving circuit of claim 4, wherein the first data signal is a direct current data signal, and the second data signal is an alternating current data signal.

12. The driving circuit of claim 3, wherein the first data signal is a direct current data signal, and the second data signal is an alternating current data signal.

13. The driving circuit of claim 2, wherein the first data signal is a direct current data signal, and the second data signal is an alternating current data signal.

14. The driving circuit of claim 1, wherein the first data signal is a direct current data signal, and the second data signal is an alternating current data signal.

15. A display panel, comprising a driving circuit, wherein the driving circuit is configured for image display and comprises:

a first light-emitting control sub-circuit and a second light-emitting control sub-circuit, both of which are electrically connected to a light-emitting unit, an energy storage element, an operational sub-circuit, a first data input sub-circuit, a second data input sub-circuit, and a first power supply voltage end, wherein the first light-emitting control sub-circuit and the second light-emitting control sub-circuit are both configured to drive the light-emitting unit to emit light, wherein an anode of the light-emitting unit is electrically connected to the first light-emitting control sub-circuit, the second light-emitting control sub-circuit, the energy storage element, and the operational sub-circuit, a cathode of the light-emitting unit is electrically connected to a second power supply voltage end, and the light-emitting unit is configured to emit light;

the energy storage element is electrically connected to the operational sub-circuit and is configured to store electric energy;

the operational sub-circuit is electrically connected to the first data input sub-circuit, the second data input sub-circuit, and a reference voltage end, and is configured to compare a voltage at a point where the energy storage element and the operational sub-circuit are electrically connected with a reference voltage received at the reference voltage end to obtain an output signal, and transmit the output signal to the first data input sub-circuit and the second data input sub-circuit;

the first data input sub-circuit is electrically connected with the second data input sub-circuit and a first data signal end, and is configured to be turned on or off according to the output signal transmitted through the operational sub-circuit, and transmit a first data signal input at the first data signal end to the first light-emitting control sub-circuit and the second light-emitting control sub-circuit when being turned on, to drive the light-emitting unit to emit light;

the second data input sub-circuit is electrically connected to a second data signal end, and is configured to be turned on or off according to an output signal transmitted through the operational sub-circuit, and transmit a second data signal input at the second data signal end to the first light-emitting control sub-circuit and the second light-emitting control sub-circuit when being turned on, to drive the light-emitting unit to emit light.

16. A display device, comprising a display panel, the display panel comprising a driving circuit, wherein the driving circuit is configured for image display and comprises:

a first light-emitting control sub-circuit and a second light-emitting control sub-circuit, both of which are electrically connected to a light-emitting unit, an energy storage element, an operational sub-circuit, a first data input sub-circuit, a second data input sub-circuit, and a first power supply voltage end, wherein the first light-emitting control sub-circuit and the second light-emitting control sub-circuit are both configured to drive the light-emitting unit to emit light, wherein an anode of the light-emitting unit is electrically connected to the first light-emitting control sub-circuit, the second light-emitting control sub-circuit, the energy storage element, and the operational sub-circuit, a cathode of the light-emitting unit is electrically connected to a second power supply voltage end, and the light-emitting unit is configured to emit light;

the energy storage element is electrically connected to the operational sub-circuit and is configured to store electric energy;

the operational sub-circuit is electrically connected to the first data input sub-circuit, the second data input sub-circuit, and a reference voltage end, and is configured to compare a voltage at a point where the energy storage element and the operational sub-circuit are electrically connected with a reference voltage received at the reference voltage end to obtain an output signal, and transmit the output signal to the first data input sub-circuit and the second data input sub-circuit;

the first data input sub-circuit is electrically connected with the second data input sub-circuit and a first data signal end, and is configured to be turned on or off according to the output signal transmitted through the operational sub-circuit, and transmit a first data signal input at the first data signal end to the first light-emitting control sub-circuit and the second light-emitting control sub-circuit when being turned on, to drive the light-emitting unit to emit light;

the second data input sub-circuit is electrically connected to a second data signal end, and is configured to be turned on or off according to an output signal transmitted through the operational sub-circuit, and transmit a second data signal input at the second data signal end to the first light-emitting control sub-circuit and the second light-emitting control sub-circuit when being turned on, to drive the light-emitting unit to emit light.

* * * * *